US009514911B2

(12) United States Patent
Andrews

(10) Patent No.: US 9,514,911 B2
(45) Date of Patent: Dec. 6, 2016

(54) X-RAY TUBE APERTURE BODY WITH SHIELDED VACUUM WALL

(75) Inventor: Gregory C. Andrews, Draper, UT (US)

(73) Assignee: VARIAN MEDICAL SYSTEMS, INC., Palo Alto, CA (US)

( * ) Notice: Subject to any disclaimer, the term of this patent is extended or adjusted under 35 U.S.C. 154(b) by 957 days.

(21) Appl. No.: 13/364,222

(22) Filed: Feb. 1, 2012

(65) Prior Publication Data

US 2013/0195253 A1 Aug. 1, 2013

(51) Int. Cl.
*H01J 35/14* (2006.01)
*H01J 35/16* (2006.01)

(52) U.S. Cl.
CPC ..... *H01J 35/14* (2013.01); *H01J 35/16* (2013.01); *H01J 2235/1216* (2013.01); *H01J 2235/1262* (2013.01); *H01J 2235/167* (2013.01); *H01J 2235/168* (2013.01)

(58) Field of Classification Search
CPC ..... H01J 35/14; H01J 35/16
USPC ..... 378/121–142
See application file for complete search history.

(56) References Cited

U.S. PATENT DOCUMENTS 6,075,839 A 6/2000 Treseder
6,115,454 A 9/2000 Andrews et al.
6,215,852 B1 4/2001 Rogers et al.
6,519,317 B2 2/2003 Richardson et al.
6,519,318 B1 2/2003 Andrews
6,619,318 B2 9/2003 Dalhart et al.
7,289,603 B2 10/2007 Andrews et al.
7,860,219 B2 12/2010 Clark et al.
8,000,450 B2 8/2011 Andrews
2006/0050850 A1* 3/2006 Andrews et al. ..... 378/119
2006/0050851 A1 3/2006 Boye
2007/0140431 A1* 6/2007 Miller ..... H01J 35/06 378/136
2008/0112538 A1 5/2008 Rogers
2009/0129550 A1 5/2009 Bandy et al.
2010/0278309 A1* 11/2010 Hauttmann ..... H01J 35/16 378/142
2011/0038463 A1* 2/2011 Behling ..... H01J 35/16 378/140

OTHER PUBLICATIONS

International Search Report and Written Opinion dated May 16, 2013 as received in application No. PCT/US2013/024483.
Andrews, U.S. Appl. No. 13/328,861, filed Dec. 16, 2011.

* cited by examiner

*Primary Examiner* — David J Makiya
*Assistant Examiner* — Dani Fox
(74) *Attorney, Agent, or Firm* — Maschoff Brennan

(57) ABSTRACT

X-ray tube aperture body with shielded vacuum wall. In one example embodiment, an aperture body for use in an x-ray tube having an anode and a cathode includes an electron shield and a vacuum wall. The electron shield is configured to intercept backscattered electrons from the anode. The vacuum wall is separated by a gap from the electron shield and is shielded from the backscattered electrons by the electron shield. The aperture body also includes an electron shield aperture defined in the electron shield and a vacuum wall aperture defined in the vacuum wall through which electrons may pass between the cathode and the anode.

18 Claims, 3 Drawing Sheets

X-RAY TUBE APERTURE BODY WITH SHIELDED VACUUM WALL

BACKGROUND

1. Technology Field

Embodiments of the present invention generally relate to x-ray generating devices.

2. The Related Technology

X-ray generating devices are extremely valuable tools that are used in a wide variety of applications, both industrial and medical. For example, such equipment is commonly employed in areas such as medical diagnostic examination, therapeutic radiology, semiconductor fabrication, and materials analysis.

Regardless of the applications in which they are employed, most x-ray generating devices operate in a similar fashion. X-rays are produced in such devices when electrons are emitted, accelerated, and then impinged upon a material of a particular composition. This process typically takes place within an x-ray tube located in the x-ray generating device.

One challenge encountered with the operation of x-ray tubes relates to backscattered electrons, i.e., electrons that rebound from the target surface along unintended paths in the vacuum enclosure. Depending on the environment, upwards of thirty percent of the electrons traveling from the cathode to the anode hit and bounce from the point of impingement. These rebounding, backscattered electrons can impact areas of the x-ray tube where such electron impact is not desired. These impacts result in the generation of excess heat that can damage the impacted component.

For example, an impacted component might define a portion of the vacuum envelope in which critical tube components, such as the cathode and anode, are housed. Upon failure of the impacted component, the vacuum can be compromised thereby rendering the x-ray tube useless, requiring its replacement often at significant cost.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

Briefly summarized, embodiments of the present invention are directed to an aperture body for use in an x-ray tube and configured for interposition between an electron emitter and an anode configured to receive the emitted electrons. In example embodiments, the aperture body includes an electron shield and a vacuum wall that is shielded from the backscattered electrons by the electron shield. This shielding of the vacuum wall reduces the incidence of failure in the vacuum wall and increases the overall operating life of the x-ray tube.

In one example embodiment, an aperture body for use in an x-ray tube having an anode and a cathode includes an electron shield and a vacuum wall. The electron shield is configured to intercept backscattered electrons from the anode. The vacuum wall is separated by a gap from the electron shield and is shielded from the backscattered electrons by the electron shield. The aperture body also includes an electron shield aperture defined in the electron shield and a vacuum wall aperture defined in the vacuum wall through which electrons may pass between the cathode and the anode.

In another example embodiment, an x-ray tube includes a cathode at least partially positioned within a cathode housing, an anode at least partially positioned within a can, and an aperture body coupling the cathode housing to the can. The aperture body defines an electron shield and a vacuum wall. The electron shield is configured to intercept backscattered electrons from the anode. The vacuum wall is separated by a gap from the a electron shield and is shielded from the backscattered electrons by the electron shield. The aperture body also includes an electron shield aperture defined in the electron shield and a vacuum wall aperture defined in the vacuum wall through which electrons may pass between the cathode and the anode.

In yet another example embodiment, an x-ray tube includes a cathode at least partially positioned within a cathode housing, an anode at least partially positioned within a can, a magnetic steering mechanism configured to create a magnetic field that steers a stream of electrons flowing from cathode to the anode, and an aperture body coupling the cathode housing to the can. The aperture body defines an electron shield and a vacuum wall. The electron shield is configured to intercept backscattered electrons from the anode. The vacuum wall is separated by a gap from the electron shield and is shielded from the backscattered electrons by the electron shield. The aperture body also includes an electron shield aperture defined in the electron shield and a vacuum wall aperture defined in the vacuum wall through which electrons may pass between the cathode and the anode.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features will be set forth in the description which follows, and in part will be obvious from the description, or may be learned by the practice of the teachings herein. Features of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

Figure 1:
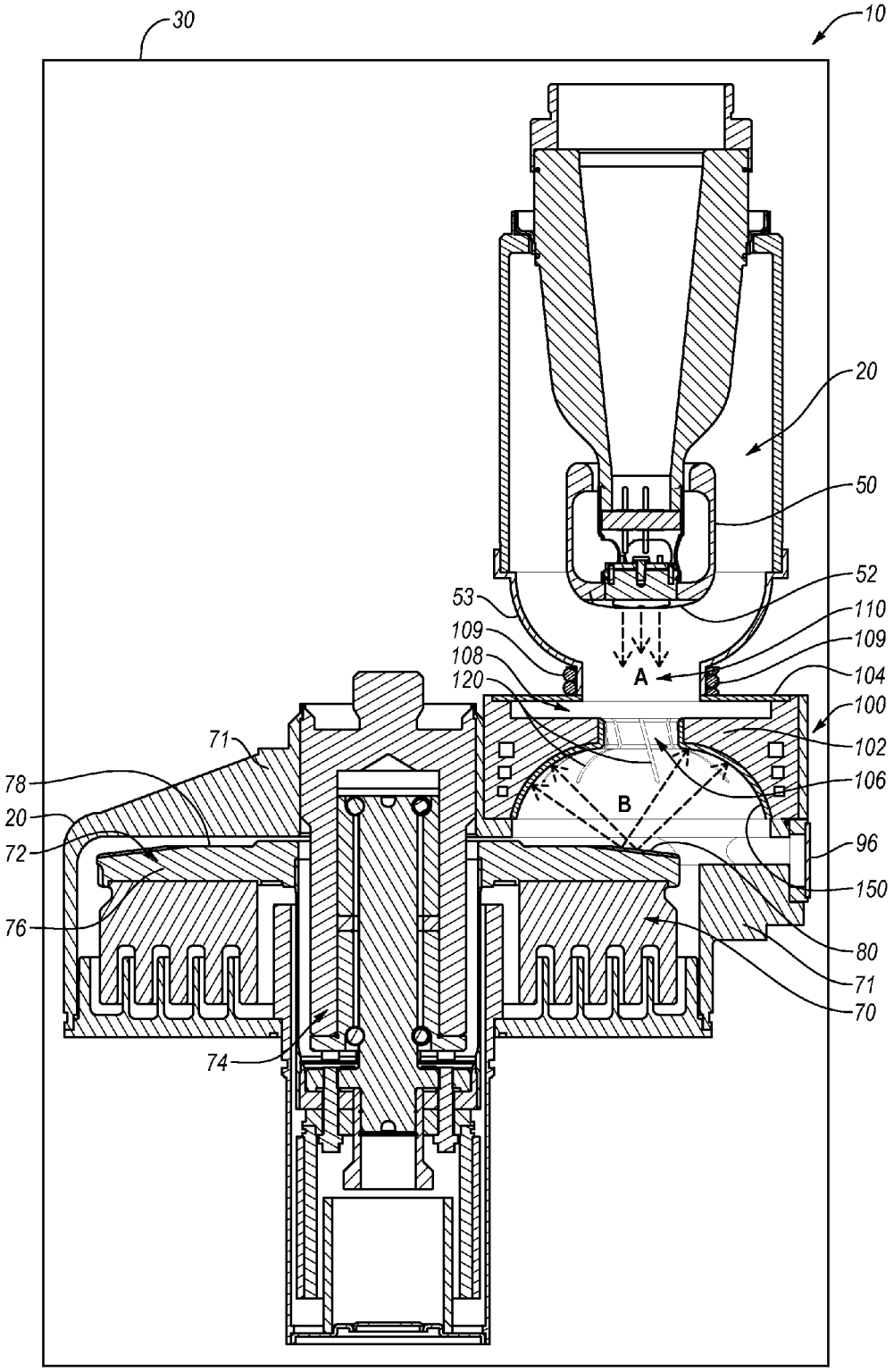
FIG. 1 is a cross sectional view of an x-ray tube that serves as one example environment in which embodiments of the present invention can be practiced.
Figure 2:
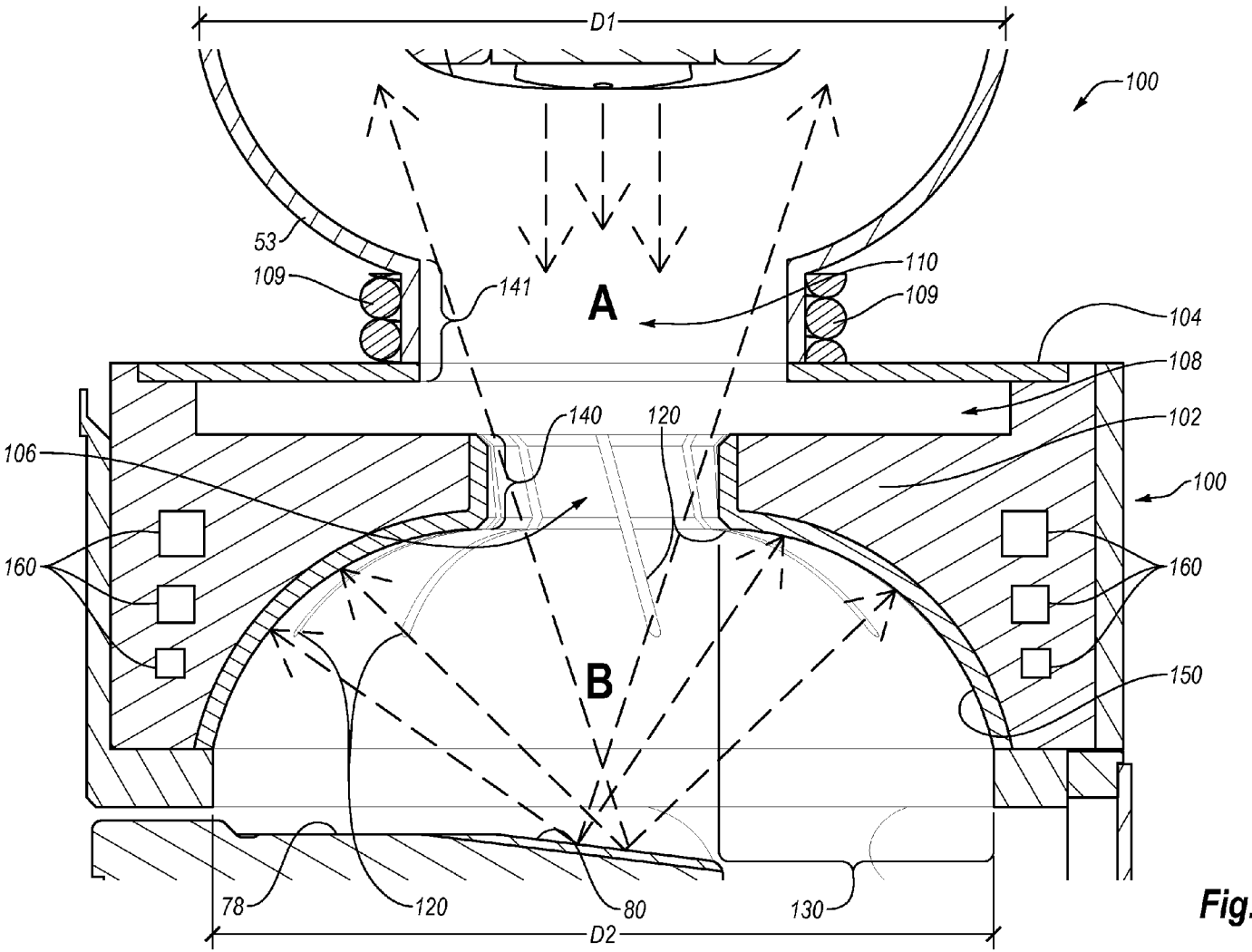
FIG. 2 is an enlarged cross sectional view of a portion of the x-ray tube of FIG. 1.
Figure 3:
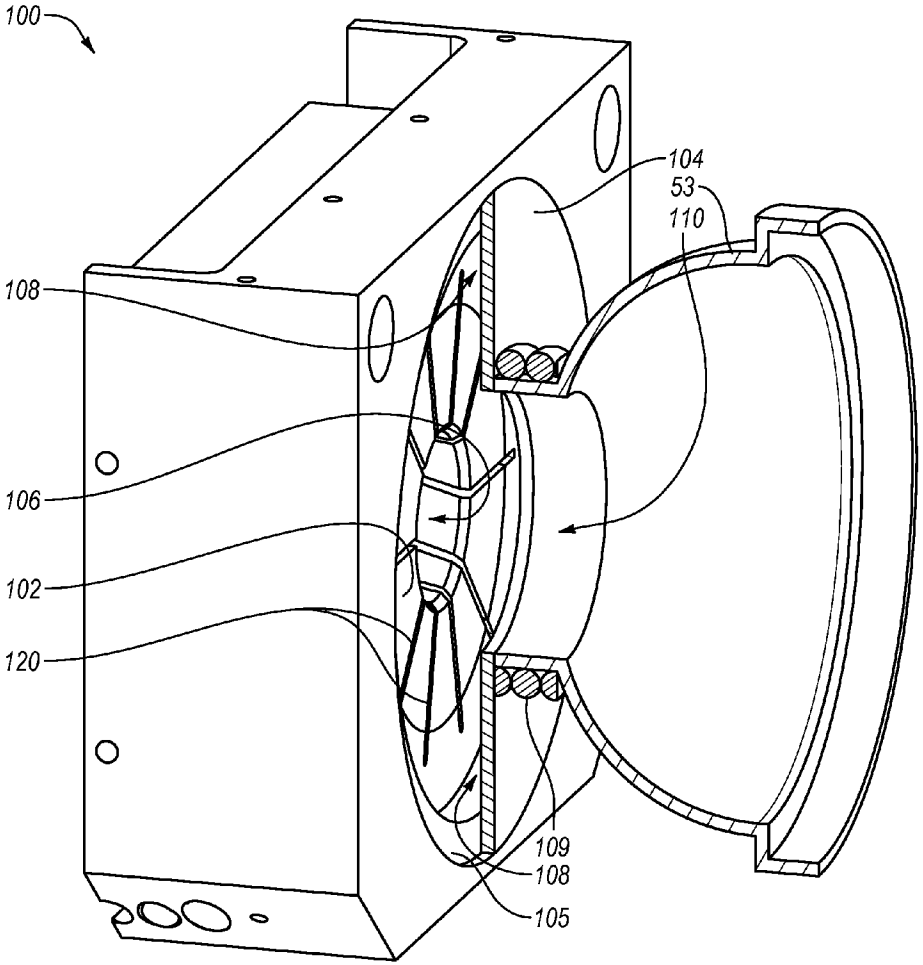
FIG. 3 is a partial perspective view of an aperture body, cathode housing, and magnetic steering mechanism of the x-ray tube of FIGS. 1 and 2.

FIGS. 1-3 depict various features of example embodiments. In general, embodiments are generally directed to an aperture body for interposition between an electron emitter and an anode configured to receive the emitted electrons, such as in an x-ray tube. The aperture body includes an electron shield and a vacuum wall. The primary function of the electron shield is to "collect" electrons backscattered from the anode. Advantageously, the electron shield is configured to withstand the elevated temperatures produced by backscattered electrons and incident on selected portions of the electron shield and resultant thermal stresses that occur. The electron shield is also configured to shield the vacuum wall from backscattered electron. This in turn equates to a reduced incidence of failure in the electron shield and in the vacuum envelope, or evacuated enclosure, that the vacuum wall partially defines in the x-ray tube. In particular, there is a gap between the vacuum wall and the electron shield so as to separate the vacuum wall from the electron shield, thereby reducing the conduction or radiation of heat from the electron shield from damaging the vacuum wall.

Reference is first made to FIG. 1, which depicts one possible environment wherein embodiments can be practiced. Particularly, FIG. 1 shows an x-ray tube environment, designated generally at 10, which serves as one example of an x-ray generating device. The x-ray tube 10 generally includes an evacuated enclosure 20, disposed within an outer housing 30. The evacuated enclosure 20 defines and provides the necessary vacuum envelope for housing the cathode assembly 50 and the anode assemblies 70 and other critical components of the tube 10 while providing the shielding and cooling necessary for proper x-ray tube operation. Typically, the housing 30 contains a coolant that is circulated via cooling system pump (not shown) to remove heat from the surface of the evacuated enclosure. The evacuated enclosure 20 in one embodiment further includes shielding (not shown) that is positioned so as to prevent unintended x-ray emission from the tube 10 during operation. Note that, in other embodiments, the x-ray shielding is not included with the evacuated enclosure, but rather is joined to the outer housing that envelops the evacuated enclosure. In yet other embodiments, the x-ray shielding may be included neither with the evacuated enclosure nor the outer housing, but in another predetermined location.

In greater detail, the cathode assembly 50 is responsible for supplying a stream of electrons for producing x-rays, as previously described. The cathode assembly 50 includes a cathode head 52 that houses an electron source (not shown), such as a filament, for the emission of electrons during tube operation. The cathode assembly 50 is at least partially positioned within a cathode housing 53. The electron source is connected to an electrical power source (not shown) to enable the production of relatively high-energy electrons.

Generally responsible for receiving the electrons produced by the electron source and converting them into x-rays to be emitted from the evacuated enclosure 20, the anode assembly 70 includes an anode 72 and an anode support assembly 74. While any one of a different number of configurations could be used, the example embodiment includes an anode 72 having a target surface 78 and a substrate 76. The target 78 is composed of Tungsten or a similar alloy. A focal track 80, typically formed along an angled outer periphery of the target surface 78, is positioned such that the stream of electrons emitted by the filament impinge on the focal track and produce x-rays (not shown) for emission from the evacuated enclosure 20 via an x-ray transmissive window 96. The anode assembly 70 is at least partially positioned with a can 71.

In greater detail, the anode 72/substrate 76 is rotatably supported by the anode support assembly 74, which generally includes a rotor and stator assembly. The stator is circumferentially disposed about a portion of the rotor assembly to provide the needed rotation of the anode 72 during tube operation. Again, it should be appreciated that embodiments of the present invention can be practiced with anode assemblies having configurations that differ from that described herein. For example, embodiments of the electron shield discussed herein might have applicability in connection with a stationary anode implementation.

As the production of x-rays described herein is relatively inefficient and yields large quantities of heat, the anode assembly 70 is configured to allow for heat removal during tube operation such as, for instance, circulation of a cooling fluid through designated structures of the anode assembly. Notwithstanding the above details, however, the structure and configuration of the anode assembly can vary from what is described herein while still residing within the claims of the present invention.

The example aperture body, generally designated at 100, is positioned between the cathode head 52 and the anode 72. Both the anode 72 and the aperture body 100 are configured to be electrically grounded during operation of the x-ray tube 10. The aperture body 100 couples the cathode housing 53 to the can 71. The aperture body 100 defines an electron shield 102 and a vacuum wall 104. An electron shield aperture 106 is defined in the electron shield 102 and a vacuum wall aperture 110 is defined in the vacuum wall 104 through which electrons (schematically represented as dotted lines denoted at 'A') may pass from the cathode head 52 for impingement upon the focal track 80 of the anode target surface 78. The vacuum wall 104 is separated by a gap 108 from the electron shield 102.

The x-ray tube environment 10 may further include a magnetic steering mechanism 109 that are configured to create a magnetic field that steers the stream of electrons 'A' flowing from cathode to the anode. As disclosed in FIG. 1, the magnetic steering mechanism 109 at least partially surrounds the cathode housing 53 and resides outside the evacuated enclosure 20 of the x-ray tube environment 10. Positioning the magnetic steering mechanism 109 outside the evacuated enclosure 20 may enable the magnetic steering mechanism 109 to be efficiently cooled by the aforementioned coolant that circulates in the housing 30.

The electron shield 102 is configured to intercept electrons that rebound, or "backscatter," from the anode focal track 80 during tube operation. Examples of such "backscattered" or "rebounded" electrons are represented as dotted lines denoted at 'B'. Interception of the backscattered electrons by the electron shield 102 preferably occurs along a collection surface 150 portion of the electron shield 102, thereby preventing the electrons from impacting and possibly damaging other tube components, such as the vacuum wall 104 and the cathode housing 53. The collection surface 150 might have any one of a number of configurations and shapes that achieve the objective of collecting backscattered electrons as the rebound from the surface of the anode. In the embodiment illustrated in FIG. 1 the collection surface is formed with a generally bowl or concave shape. In this illustrated example the collection surface 150 is oriented to generally face the anode. Of course, other configurations might be used. For example, the collection surface may be formed as a substantially cylindrical passageway interposed between the anode and cathode. Alternatively it might be formed as a cylinder with a non-uniform diameter along its length. Non-limiting examples of different "collection surface" configurations are shown, for example, in U.S. Pat. No. 7,289,603 entitled "Shield Structure and Focal Spot Control Assembly for X-ray Device," the disclosure of which is incorporated herein by reference in its entirety.

In example embodiments, the electron shield 102 includes one or more expansion joints that are configured to accommodate thermal expansion within the collection surface 150 and the electron shield aperture 106 are preferably provided in the form of one or more openings or gaps provided in electron shield 102 so as to provide areas into which the aperture body 100 can expand when heated. Again, these joints allow for elastic expansion and contraction in the electron shield 102 so as to reduce maximum mechanical stresses and reducing, for example, cracking and delamination at the collection surface 150.

In the embodiment illustrated in FIG. 1, the expansion joints are provided as a plurality of slots, denoted at 120, formed in the collection surface 150 and through the electron shield 102 of the aperture body 100. While different orientations and arrangements might be used, in a preferred embodiment the slots are disposed as illustrated so as to extend radially outward from the central electron shield aperture 106. The slots might have different widths and/or lengths with respect to one another. In the illustrated embodiment each of the slots has substantially the same width and length, depending on the thermal response that may be desired. As is shown in the example embodiment, the slots extend completely through the electron shield 102. In addition, in preferred embodiments the slots are oriented at a slight angle offset with respect to the direction of electron travel so as to prevent backscattered electrons from passing completely through the slots without intercepting the electron shield 102. The illustrated slots are one non-limiting example of structure corresponding to means for accommodating thermal expansion with regions of the electron shield 102, including the collection surface 150 and the electron shield aperture 106.

Reference is now made to FIGS. 2 and 3 which show additional details of an example aperture body implementation. As suggested, the electron shield 102 is configured to withstand the extreme temperatures imparted thereto as the result of its absorption of backscattered electrons. Specifically, the example electron shield 102 is implemented such that those regions of the electron shield 102 that are subject to relatively more electron impacts from backscattering are relatively more suited to withstand the resultant thermal stress.

In detail, FIG. 2 shows that the electron shield aperture 106 and the vacuum wall aperture 110 allow electrons emitted by the electron source to pass through the apertures en route to impingement on the focal track 80 of the anode target surface 78. The electron collection surface 150 that is fashioned in the shape of a concave or bowl 130 and a throat 140. Note that the electron shield 102 might be compositely formed of a single piece or could be formed of more than one piece.

In the illustrated embodiment, the bowl 130 and the throat 140 of the electron collection surface 150 are composed of a refractory material, such as molybdenum, tungsten, or niobium, or suitable allows such as TZM (an alloy composed of tungsten, zirconium, and molybdenum). A refractory material such as TZM is mechanically stable at high operating temperatures, which further prevents cracking or failure of the electron shield 102. TZM also exhibits a high yield strength, which enables the electron shield 102 to be made relatively thinner while still maintaining suitable shield strength. For instance, GLIDCOP® has a yield strength of about 45 ksi, while standard refractory materials have a yield strength of about 150 ksi. A thinner electron shield structure improves heat conductivity from the electron shield 102 to heat removing components of the x-ray tube 10, such as cooling fluid circulated about the electron shield 100 and/or over an outer surface of the shield. This also mitigates the fact that refractory materials have a lower thermal conductivity compared to OFHC copper or GLIDCOP®.

It is appreciated that, in addition to refractory material, other materials may be suited for use in the electron shield 102. Preferred characteristics of the material include thermal stability at the high temperatures encountered in the electron shield, relatively high thermal conductivity, acceptable mechanical strength, and a coefficient of thermal expansion that is sufficiently similar to the other materials from which the electron shield is composed—such as OFHC and GLIDCOP® in the present embodiment. Thus, it should be appreciated that composition of the electron shield 102 should not be limited only to what is explicitly described herein. Also, depending on the particular thermal requirements, the entire shield might be comprised of a single material, such as copper.

The vacuum wall 104 is positioned behind the electron collection surface 150 of the electron shield 102 so as to be generally shielded from backscattered electrons. The cathode housing 53 and the vacuum wall aperture 110 define a throat portion 141. The throat portion 141 is sized and positioned so that the throat 140 of the electron collection surface 150 generally shields the throat portion 141 from backscattered electrons. This is accomplished in some embodiments by making the area of the vacuum wall aperture 110 greater than the area of the electron shield aperture 106.

The gap 108 that separates the vacuum wall 104 from the electron shield 108 is generally configured to minimize the amount of heat that radiates or conducts from the electron shield 102 to the vacuum wall 104, thus reducing heat-related stresses on the vacuum wall. Maximizing the perimeter and width of the gap 108 tends to minimize the amount of heat that is conducted and radiated from the electron shield 102. Unlike x-ray tube embodiments where the electron shield itself forms the vacuum wall, the separation of the electron shield 102 and the vacuum wall 104 by the gap 108 dramatically reduces the amount of backscattered heat-related stress on the vacuum wall 104. As disclosed in FIG. 3, the vacuum wall 104 may be a separate piece from the electron shield 102, and may be attached to a surface 105 of the aperture body 100 using a variety of techniques, such as brazing for example. The vacuum wall may be formed from various materials, such as 304 stainless steel for example. As disclosed in FIG. 2, the gap 108 may extend to substantially the entire area directly behind the electron collection surface 150. In other words, in embodiments where outer perimeters of the gap 108 and the electron collection surface 150 are substantially circular, the perimeter diameter D1 of the gap 108 may be greater than or equal to the perimeter diameter D2 of the electron collection surface 150.

Further, in some example embodiments, the portion of the electron shield 102 near the exterior of the electron shield 102 has defined therein a plurality of fluid channels 160 for the conduction of heat from the electron shield 102. Absorption by the electron shield 102 of the majority of backscattered electrons during tube operation results in large quantities of heat being imparted to the electron shield 102. The fluid channels 160 annularly surround exterior portions of the electron shield 102 including the bowl 130 and the throat 140. The fluid passageways 160 are employed to contain a coolant that can be circulated through the passageways to remove this heat from the electron shield 102. Again, the specific implementation of the fluid passageways is not limited to what is shown. The number, relative sizes, positioning within the electron shield 102 and/or cross-sectional shapes all might be varied depending on the needs of a particular application and/or implementation. Further, cooling fins (not shown) may also be located on the outer surface of the aperture body 100 or within the fluid passageways 160. The cooling fins would further enhance the transfer of heat to the outer surface of the aperture body 100 and to coolant disposed within the housing 30. Examples and additional details of the use of such cooling fins in an aperture body can be found in U.S. Pat. No. 8,000,450 entitled "Aperture Shield Incorporating Refractory Materials," the disclosure of which is incorporated herein by reference in its entirety. Again, various configurations can be used depending on the needs of a particular implementation.

The aperture body 100 including the gap 108 between the electron shield 102 and the vacuum wall 104 as described above reduces stress on the vacuum wall 104 from backscattered electrons. This is so because the electron shield 102 substantially shields the vacuum wall 104 from backscattered electrons. Thus, shield heating is provided for with minimized impact on the vacuum wall 104.

The present invention may be embodied in other specific forms without departing from its spirit or essential characteristics.

Thus, all of the described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An aperture body for use in an x-ray tube that provides an evacuated interior having an anode and a cathode, the aperture body comprising:

an electron shield having an electron collection surface including one or more expansion joints formed therein, the electron shield configured to intercept backscattered electrons from the anode;

an electron shield aperture defined in the electron shield through which electrons may pass between the cathode and the anode;

a vacuum wall separated by a gap from the electron shield and shielded from the backscattered electrons by the electron shield, wherein the gap is disposed within the evacuated interior and is in fluid communication with the evacuated interior, wherein the vacuum wall is electrically coupled to the electron shield such that the aperture body is electrically grounded during operation of the X-ray tube; and a vacuum wall aperture defined in the vacuum wall through which electrons may pass between the cathode and the anode.

2. The aperture body of claim 1, wherein the gap separating the vacuum wall from the electron shield extends to the entire area directly behind the electron collection surface.

3. The aperture body of claim 1, wherein the vacuum wall aperture has a greater area than the electron shield aperture.

4. The aperture body of claim 1, wherein the vacuum wall is brazed to a portion of the aperture body.

5. An x-ray tube comprising:

a cathode at least partially positioned within a cathode housing;

an anode at least partially positioned within a can; and an aperture body coupling the cathode housing to the can so as to provide an evacuated interior, the aperture body defining:

an electron shield configured to intercept backscattered electrons from the anode;

an electron shield aperture defined in the electron shield through which electrons may pass between the cathode and the anode;

a vacuum wall separated by an evacuated gap from the electron shield and shielded from the backscattered electrons by the electron shield, wherein the vacuum wall is electrically coupled to the electron shield such that the aperture body is electrically grounded during operation of the X-ray tube; and a vacuum wall aperture defined in the vacuum wall through which electrons may pass between the cathode and the anode.

6. The x-ray tube of claim 5, wherein the electron shield includes:

an electron collection surface; and one or more expansion joints formed in the electron collection surface.

7. The x-ray tube of claim 5, wherein:

the electron shield includes an electron collection surface; and the gap separating the vacuum wall from the electron shield extends to the entire area behind the electron collection surface.

8. The x-ray tube of claim 5, wherein:

the vacuum wall aperture has a greater area than the electron shield aperture; and the electron shield is configured to shield the cathode housing from the backscattered electrons.

9. The x-ray tube of claim 8, wherein the electron shield is configured to shield the cathode housing between the cathode and the anode from the backscattered electrons.

10. The x-ray tube of claim 5, wherein the aperture body further defines a plurality of cooling fins configured to interact with a fluid coolant in which the x-ray tube is at least partially submersed during operation.

11. The x-ray tube of claim 5, wherein both the anode and the aperture body are configured to be electrically grounded during operation.

12. An x-ray tube comprising:

a cathode at least partially positioned within a cathode housing;

an anode at least partially positioned within a can;

a magnetic steering mechanism configured to create a magnetic field that steers a stream of electrons flowing from cathode to the anode; and an aperture body coupling the cathode housing to the can so as to provide an evacuated interior, the aperture body defining:

an electron shield configured to intercept backscattered electrons from the anode;

an electron shield aperture defined in the electron shield through which electrons may pass between the cathode and the anode;

a vacuum wall separated by a gap from the electron shield and shielded from the backscattered electrons by the electron shield, wherein the gap is in fluid communication with the evacuated interior and the vacuum wall and the electron shield mechanically and electrically coupled to define the gap such that the aperture body is electrically grounded during operation of the X-ray tube; and a vacuum wall aperture defined in the vacuum wall through which electrons may pass between the cathode and the anode.

13. The x-ray tube of claim 12, wherein the magnetic steering mechanism at least partially surrounds the cathode housing and resides outside the evacuated interior of the x-ray tube.

14. The x-ray tube of claim 12, wherein the electron shield includes:

an electron collection surface; and one or more expansion joints formed in the electron collection surface.

15. The x-ray tube of claim 14, wherein an outer perimeter of the gap separating the vacuum wall from the electron shield extends to the entire area behind the electron collection surface.

16. The x-ray tube of claim 14, wherein at least a portion of the electron collection surface comprises a refractory material.

17. The x-ray tube of claim 12, wherein:

the vacuum wall aperture has a greater area than the electron shield aperture; and the electron shield is configured to shield the cathode housing from the backscattered electrons.

18. The x-ray tube of claim 12, wherein both the anode and the aperture body are configured to be electrically grounded during operation.

* * * * *